US011746486B2

(12) United States Patent
Kempen et al.

(10) Patent No.: US 11,746,486 B2
(45) Date of Patent: Sep. 5, 2023

(54) VEHICLE ESCAPE RAMP SAFETY ARRESTING SYSTEM

(71) Applicant: IMPACT TECHNOLOGIES VI, Saint Thomas, VI (US)

(72) Inventors: Michael Kempen, Saint Thomas, VI (US); Michael Brackin, Bryan, TX (US)

(73) Assignee: IMPACT TECHNOLOGIES VI, St. Thomas, VI (US)

( * ) Notice: Subject to any disclaimer, the term of this patent is extended or adjusted under 35 U.S.C. 154(b) by 209 days.

(21) Appl. No.: 17/240,784

(22) Filed: Apr. 26, 2021

(65) Prior Publication Data

US 2021/0332541 A1 Oct. 28, 2021

Related U.S. Application Data

(60) Provisional application No. 63/014,854, filed on Apr. 24, 2020.

(51) Int. Cl.
*E01F 13/12* (2006.01)
*E01F 15/06* (2006.01)

(52) U.S. Cl.
CPC ..... *E01F 13/12* (2013.01); *E01F 15/06* (2013.01)

(58) Field of Classification Search
None
See application file for complete search history.

(56) References Cited

U.S. PATENT DOCUMENTS 2,237,106 A * 4/1941 Minert ..... B61L 29/023 49/34
3,211,260 A 10/1965 Jackson
3,367,608 A * 2/1968 Charno ..... B64F 1/02 244/110 R
3,738,599 A * 6/1973 Borehag ..... B64F 1/027 244/110 C
4,979,701 A * 12/1990 Colarik ..... B64F 1/02 256/23
5,762,443 A 6/1998 Gelfand et al.
5,823,705 A 10/1998 Jackson et al.
6,062,765 A * 5/2000 Dotson ..... E01F 13/12 49/34
6,702,511 B2 3/2004 Russell
7,014,388 B2 * 3/2006 Bibber ..... E01F 13/12 49/34
7,083,357 B2 * 8/2006 Lamore ..... E01F 13/12 404/6
7,195,419 B2 * 3/2007 Gelfand ..... E01F 13/12 404/9

(Continued)

OTHER PUBLICATIONS

International Search Report and Written Opinion, United Sates Patent and Trademark Office, Application No. PCT/US2021/029141, dated Jul. 29, 2021.

*Primary Examiner* — Thomas B Will
*Assistant Examiner* — Katherine J Chu
(74) *Attorney, Agent, or Firm* — Gottlieb, Rackman & Reisman, PC

(57) ABSTRACT

A vehicle escape ramp arresting system that includes a narrowed internal width and includes housing connection that limits the peak initial load that can be applied to a metal tape during a vehicle impact with a net and allows a housing associated with the system to rotate about both the vertical and horizontal axes to aid in slowing an errant vehicle.

10 Claims, 18 Drawing Sheets

(56) References Cited

U.S. PATENT DOCUMENTS

| | | | | |
|---|---|---|---|---|
| 7,210,873 | B2 * | 5/2007 | Gelfand | E01F 13/12 404/6 |
| 7,374,362 | B1 * | 5/2008 | Metzger | E01F 13/12 49/34 |
| 7,785,031 | B2 * | 8/2010 | Vellozzi | B61L 29/08 49/34 |
| 8,007,198 | B1 * | 8/2011 | La Valley | E01F 13/123 404/6 |
| 2010/0143033 | A1 * | 6/2010 | Metzger | E01F 13/12 188/372 |
| 2016/0199236 | A1 * | 7/2016 | Ford | E04F 11/00 14/69.5 |

* cited by examiner

VEHICLE ESCAPE RAMP SAFETY ARRESTING SYSTEM

CROSS-REFERENCE TO RELATED APPLICATIONS

This application claims priority to U.S. Provisional Patent Application No. 63/014,854, filed on Apr. 24, 2020, the contents of which are incorporated herein by reference in its entirety.

FIELD OF THE INVENTION

The present disclosure is directed generally to a road safety system and more particularly to a vehicle escape ramp safety system that is designed to slow and stop an errant vehicle (e.g., truck) in a controlled, safe manner.

BACKGROUND OF THE INVENTION

Vehicle escape ramp safety systems are designed to slow and stop errant vehicles in a controlled, safe manner during emergency situations. For example, the loss of braking capabilities on steep grades is a common situation where the vehicle escape ramps are used by errant vehicles.

There are several existing systems and methods that can be used to bring an errant vehicle to a safe stop. The CatchNet system, for example, employs net stations attached to energy absorbing steel tapes that can extend from housings that are fixed to opposing sidewalls (e.g., concreate barriers) that define an escape ramp and attach to a net. A single housing can include, for example, a 200 foot long coil of approximately 2 inch wide by 0.044 inch thick energy absorbing steel that is fed through a series of offset pins 217 arranged in the housing. At a net station, an equal number of housings (e.g., typically four or more housings) are attached to the left and right sidewalls by vertical pins/rods. The pins/rods allow the housings to rotate about a vertical axis and the tapes to follow with the net as an errant vehicle moves downstream about the ramp. Typically, there are a total of two, four, or six energy absorbing tapes per net station. On each side of the net, one tape is located near the top of the net and another tape is located near the bottom of the net.

Initially, each housing is positioned such that the housing pin, tape exit location and the net are all substantially aligned perpendicular to a sidewall of an escape ramp. When the net is impacted by an errant vehicle, it wraps around the front of the vehicle as the vehicle travels downstream along the ramp. Once the net becomes taut, the housings begin to rotate, and the tapes begin to extend out of the housing. As the tapes extend, the net applies a near constant force to the vehicle and thus begins the energy absorbing process to bring the errant vehicle to a controlled stop.

The near constant force applied to the vehicle via the net is controlled by the force required to extend the tape from each housing. This force is controlled by the frictional forces that occur between the tapes and the offset pins. In addition, this force is controlled by the forces involved with bending of the steel strap (e.g., tape) around the offset pins as it exits the housing. Thus, energy is absorbed by a combination of bending and friction forces.

SUMMARY OF THE INVENTION

The present invention is directed to an improved vehicle escape ramp arresting system. The present disclosure includes at least two improvements to the CatchNet System.

First, the internal width of the vehicle escape ramp is narrowed by reducing the interior width of the ramp (e.g., forming a tapered throat) just prior to net stations. The typical width of a vehicle escape ramp is 20 feet between the left and right longitudinal barriers and remains constant over the full length. The present invention includes a narrowed section that transitions from the typical 20 foot width to a reduced width of approximately 14 feet 6 inches immediately preceding each net station. The reduced sections located along the length of the vehicle escape ramp ensure that an errant vehicle remains centered as it traverses the ramp. In addition, the reduced sections aid to prevent the loading a net station eccentrically and in turn overloading one side of the net station's energy absorbers.

Second, the present invention includes a modified housing connection that serves two important functions: (1) it limits the peak initial load that can be applied to a tape during a vehicle impact with a net and (2) it allows the housing to rotate about both the vertical and horizontal axes. In an embodiment, a 200 foot long coil of steel strap weighing approximately 60 pounds is arranged in each housing. When a net station is impacted by an errant vehicle, the tapes are initially at rest (zero speed) and they must accelerate to the same speed as the errant vehicle in a short amount of time. At the onset of the impact, there is an increase in the pultrusion force due to the acceleration of the weight (e.g., 60 pounds) of the steel strap. Once the steel strap is pultruded at the same rate as the speed of the vehicle, this additional increase in the pultrusion force reduces to zero.

The modified connection reduces this initial peak force by extending the time over which the steel strap is accelerated to the speed of the vehicle. This is accomplished by using two steel straps that deform plastically at a load much lower than that required to pultrude the tape through the offset pins. The first steel strap begins to deform at approximately 25 percent of the pultrusion force of the tape. The second steel strap begins to deform at approximately 50 percent of the pultrusion force of the tape.

In addition, once the first steel strap has been deployed, the modified connection allows the housing to rotate about the horizontal and vertical axes. Prior to impact, the housing nests inside of the connection bracket such that it cannot rotate about the vertical plane and it remains in the horizontal plane. Once the net station is impacted the housing can immediately rotate about the vertical axis. Once the load applied to each energy absorber exceeds 25 percent of the pultrusion force, the housing is released to rotate about a horizontal pin through the connection bracket. This allows the tape to follow the net station in both the vertical and horizontal plane as the errant vehicle pushes it downstream. This reduces the possibility of the tape rubbing on the top or bottom of the housing as the net is pushed downward or upward by the errant truck and possibly causing the tape to rupture as it is deployed.

DETAILED ESCRIPTION OF EMBODIMENTS OF THE PRESENT INVENTION

Figure 1:
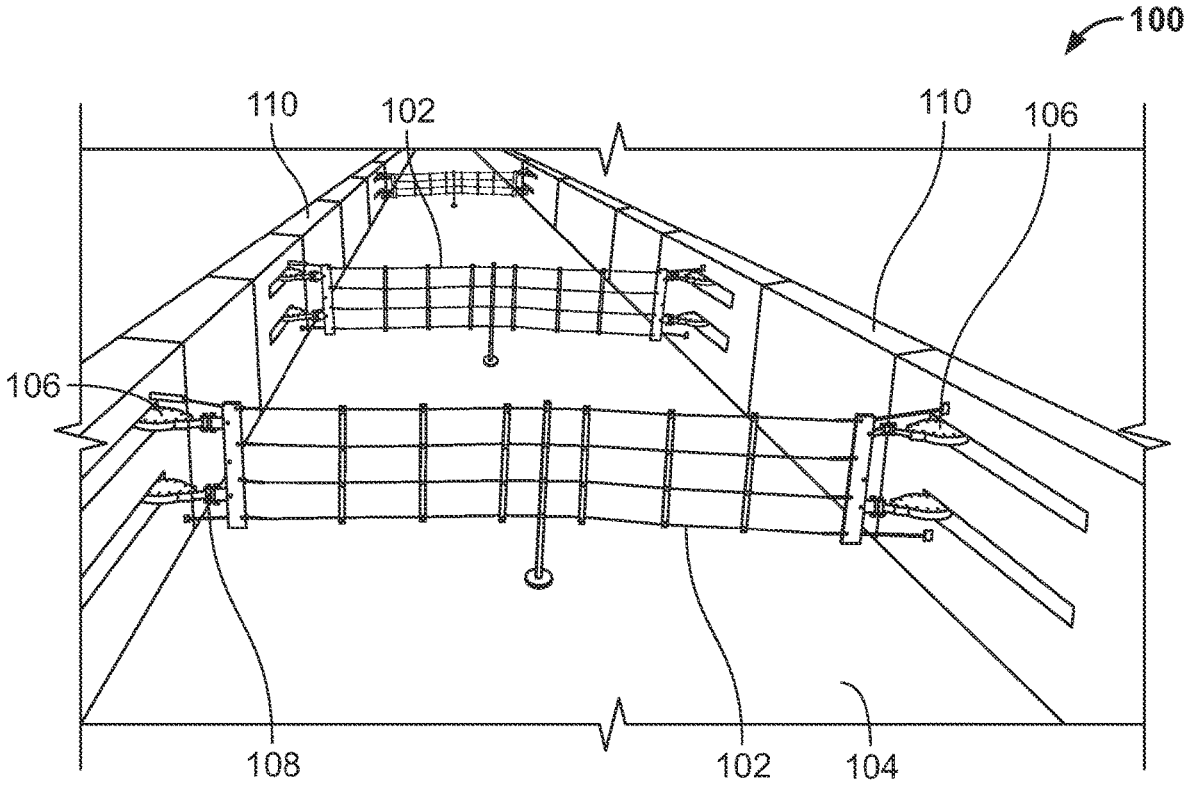
FIG. 1 (Prior Art)
FIGS. 1-3 are perspective views of an existing road safety system that is designed to slow and stop an errant vehicle.
Figure 2:
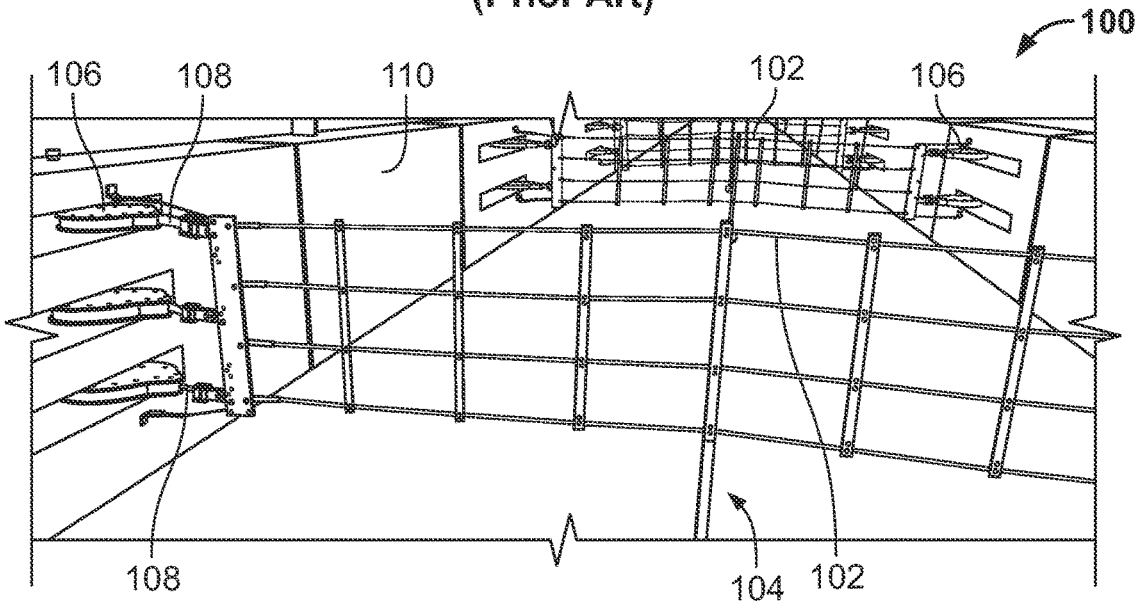
FIG. 2 (Prior Art)
Figure 3:
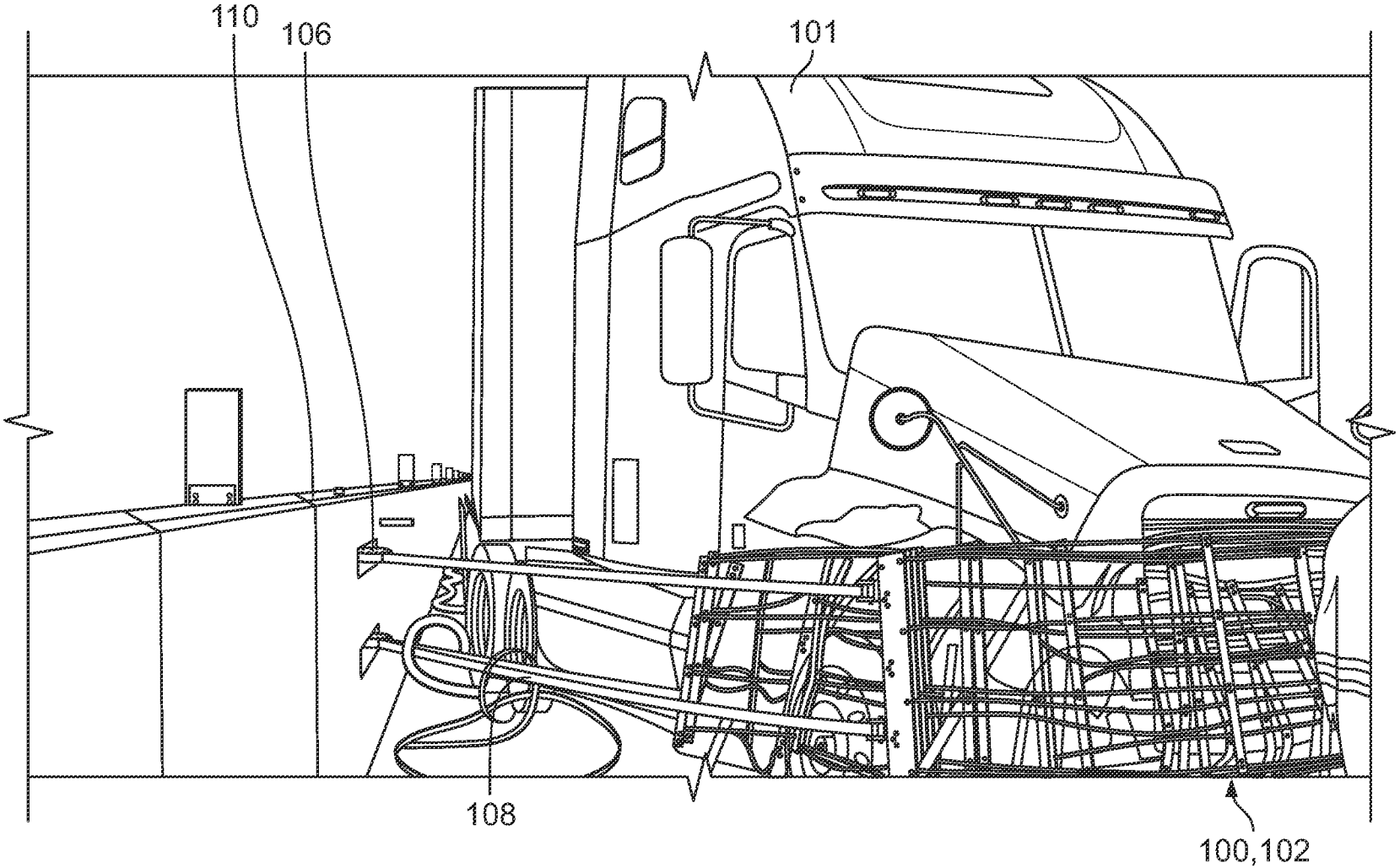
FIG. 3 (Prior Art)
Figure 4:
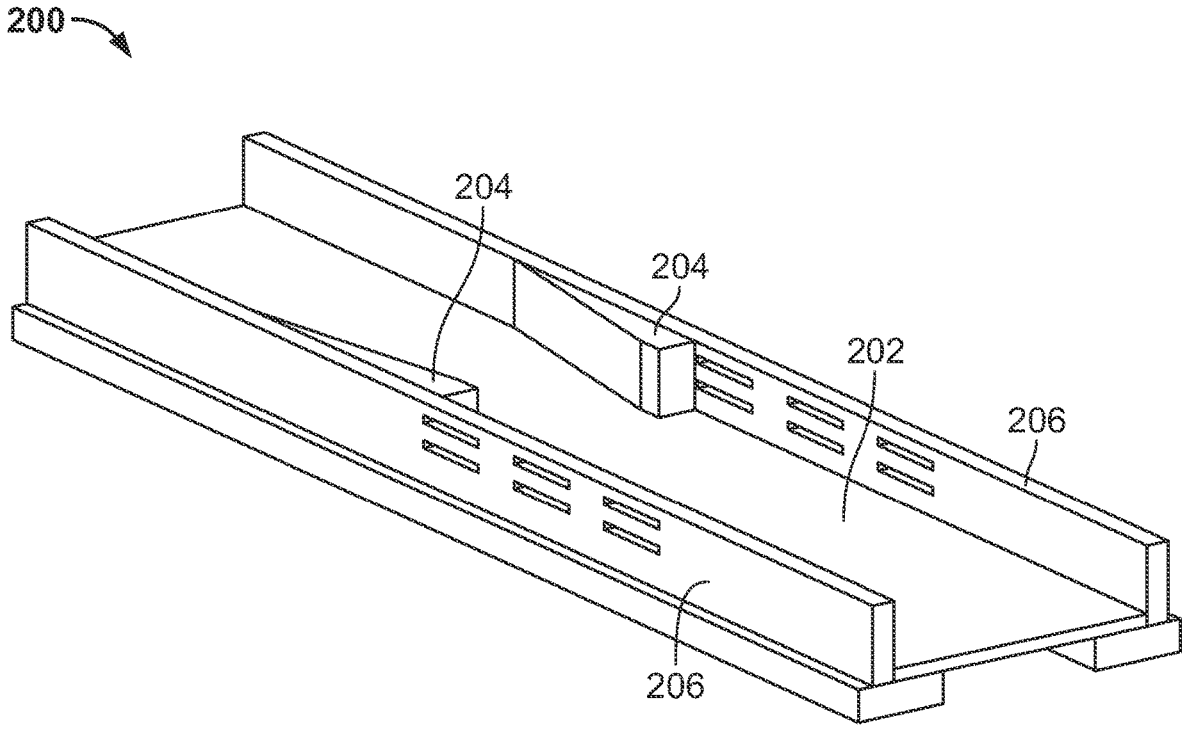
FIG. 4 is a perspective view of a ramp of the road safety system that is designed to slow and stop an errant vehicle that includes narrowed regions according to an embodiment of the present invention.
Figure 5:
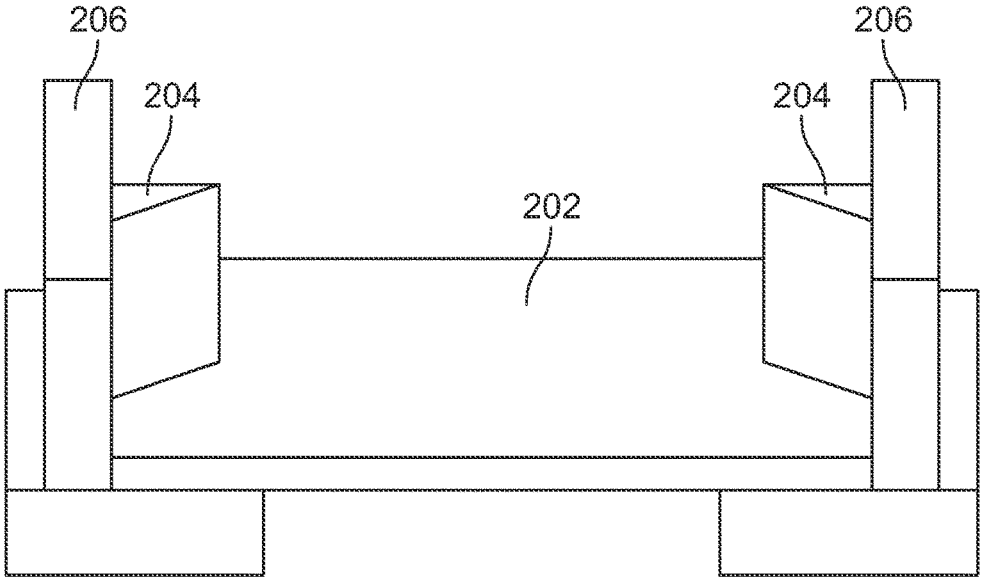
FIG. 5 is a perspective view of the narrowed section of the ramp of FIG. 4 according to an embodiment of the present invention.
Figure 6:
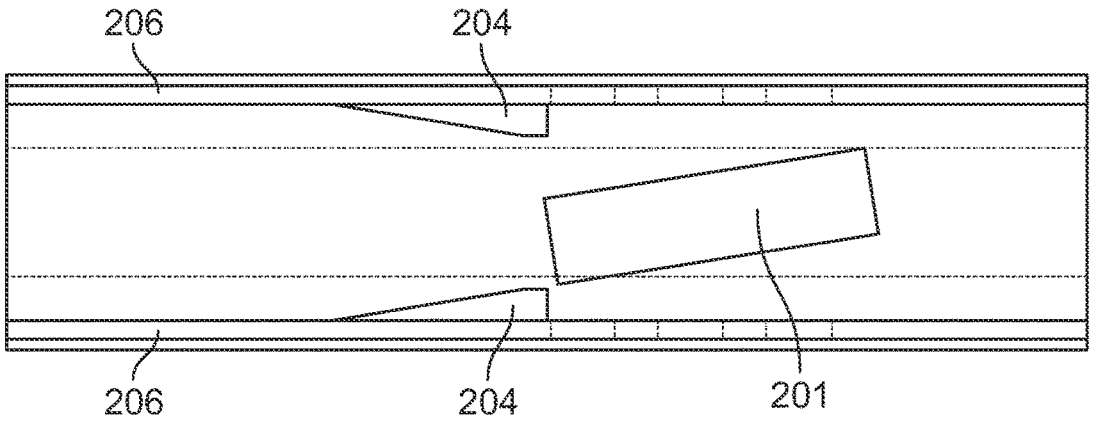
FIG. 6 is a top view of the ramp of FIG. 4 according to an embodiment of the present invention.
Figure 7:
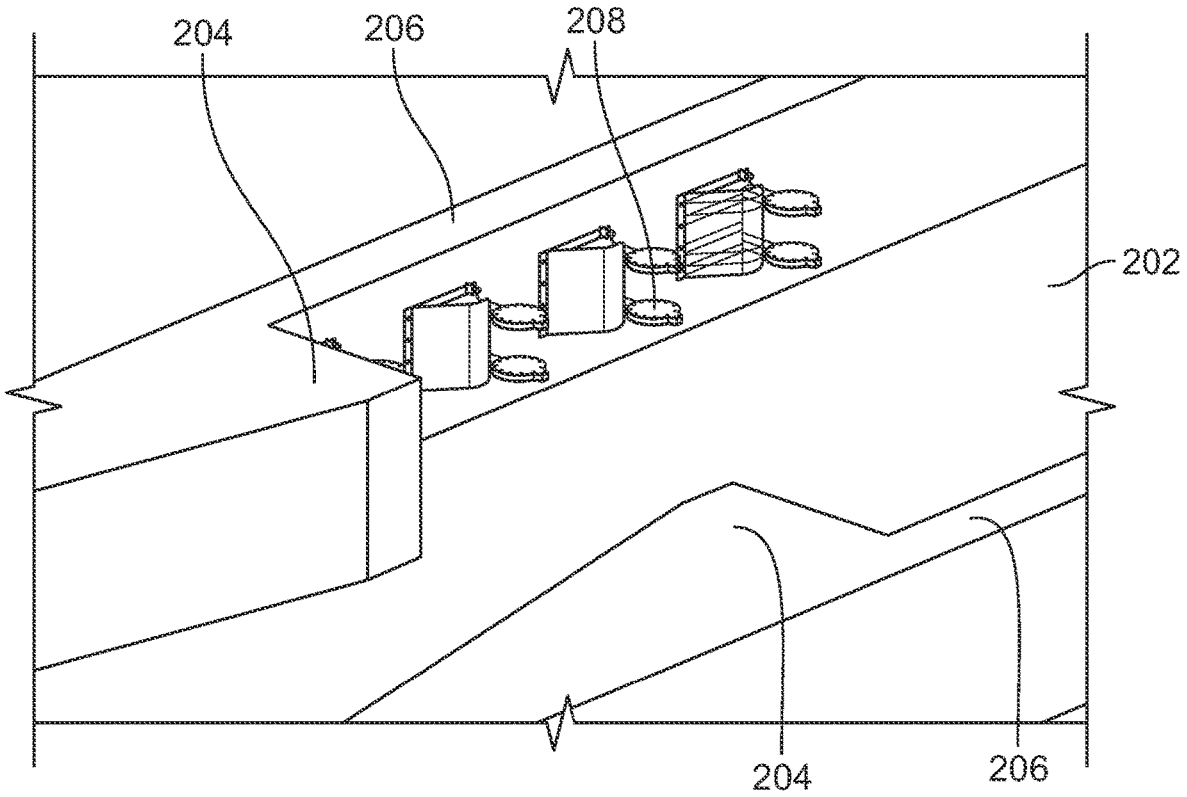
FIG. 7 is a partial perspective view of the ramp of FIG. 4 showing a plurality of swivelable housings fixed to a sidewall of the ramp of FIG. 4 according to an embodiment of the present invention.
Figure 7A:
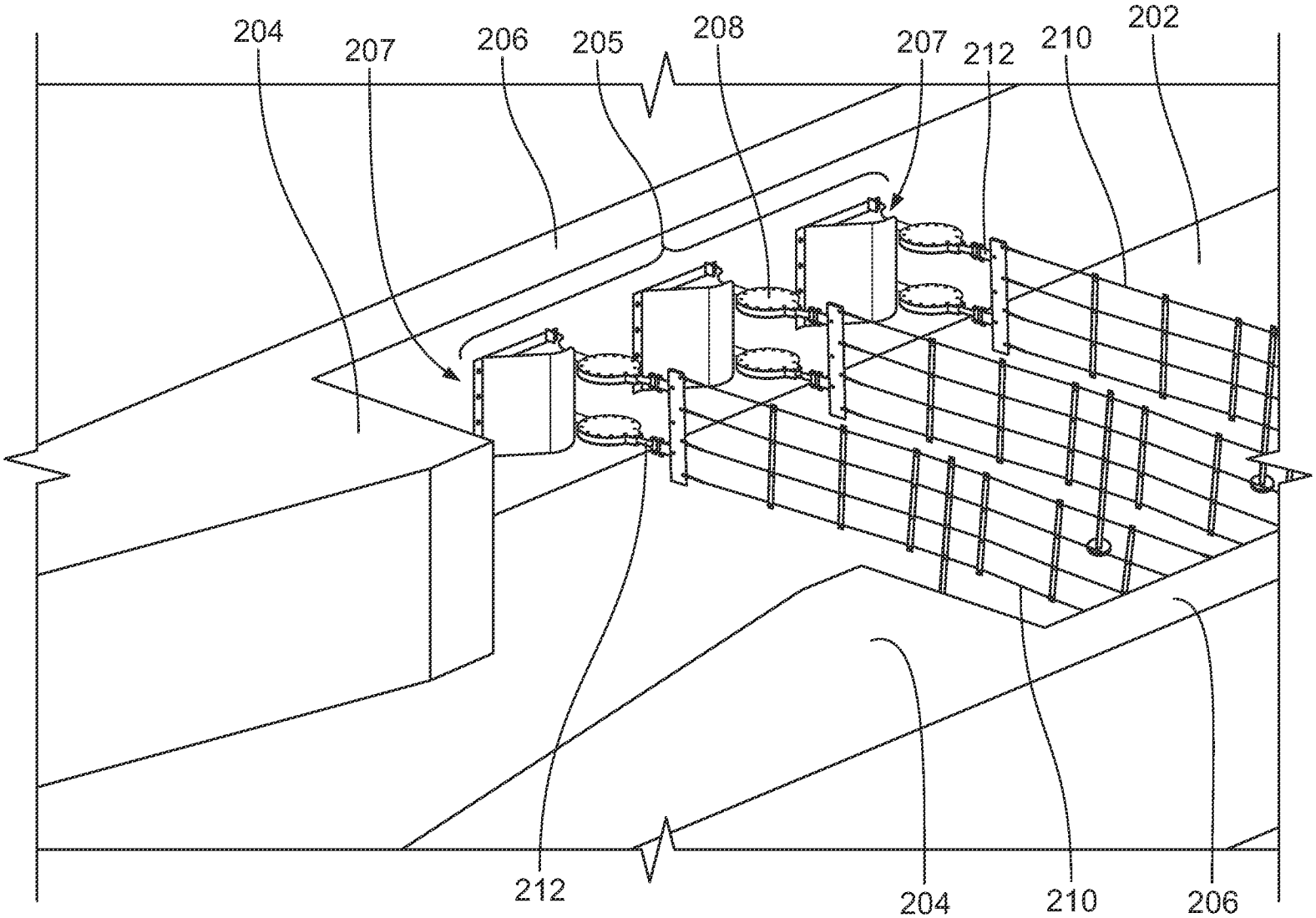
FIG. 7A is a partial perspective view of FIG. 7 showing details of the ramp of FIG. 4 according to an embodiment of the present invention.

FIGS. 1 and 2 illustrate an existing system (i.e., the CatchNet system) 100 that is intended to slow and stop an errant vehicle 101 (see FIG. 3) prior to use. As shown, nets 102 extend across an interior of a ramp 104 and are fixed to housings 106 in which steel tape 108 is coiled. The housings 106 are in turn fixed by pins to the sidewalls 110 of the ramp 104. FIG. 3 depicts the system 100 in use to slow and stop an errant truck 101. As shown, upon impact of a net 102, a tape 108 is deployed from each housing 106 associated with a respective net 102.

With reference now to the drawings and in particular FIGS. 4-40, embodiments of a vehicle escape ramp safety system 200 of the present disclosure that is configured to slow and stop an errant vehicle in a controlled, safe manner during emergency situations will be described.

FIGS. 4-7A depict various views of aspects of the vehicle escape ramp safety system 200 of the present invention. The system 200, as depicted, for example, in FIG. 7A, includes a ramp 202 that has one or more narrowed section(s), or throat(s), 204 that both center a vehicle between sidewalls 206 and protect an energy absorbing system 205 that includes a plurality of energy absorbing devices or net stations 207 that are fixed and spaced about the barriers 206 and include among other items, a housing 208, a net 210 and tape 212 (e.g., steel tape) from eccentric impact by the errant vehicle. The narrowed sections 204 can be, for example, offset about thirty-four inches from a sidewall 206 of the safety system 200 with the opening of the narrowed sections 204 being about fourteen feet to accommodate wider loads. The narrowed sections 204 can be, for example, tapered approximately nine degrees over eighteen feet.

The overall length of the truck escape ramp can be, for example, at most 600 feet in length, and the narrowed sections or throats 204 and sidewalls 206 can be configured to be reinforced concreate that meet Test Level 5 (TL-5) criteria as defined by the AASHTO Roadside Design Guide.

The vehicle escape ramp system 200 is configured to be capable of slowing and stopping a vehicle (e.g., errant tractor-trailer) that can, for example, weigh up to about 90,000 pounds and be traveling upwards of about 90 miles per hour at initial impact of the net arresting system 200 with the net stations 207 configured to apply a maximum of 0.7 g. In an embodiment, the vehicle escape ramp system 200 can be configured to slow and stop an oversized vehicle (e.g., errant oversized tractor-trailer) that can, for example, weigh about 129,000 pounds and is traveling at about 90 miles per hour at an initial impact of the net arresting system 200 with the net stations 207 configured to apply a maximum of 1.0 g.

Figure 8:
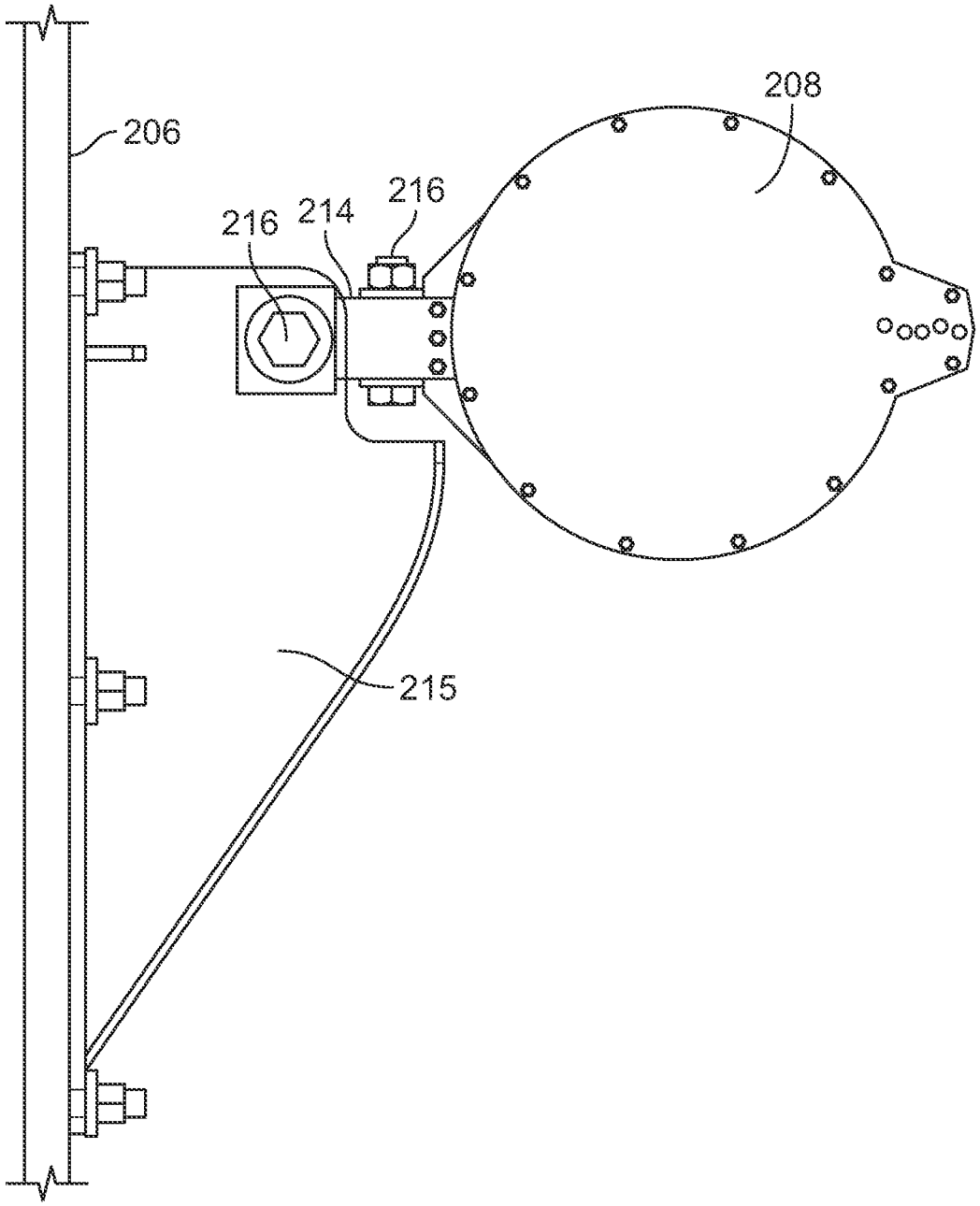
FIG. 8 is a top view of a housing assembly fixed to a sidewall of the ramp according to an embodiment of the present invention.
Figure 9:
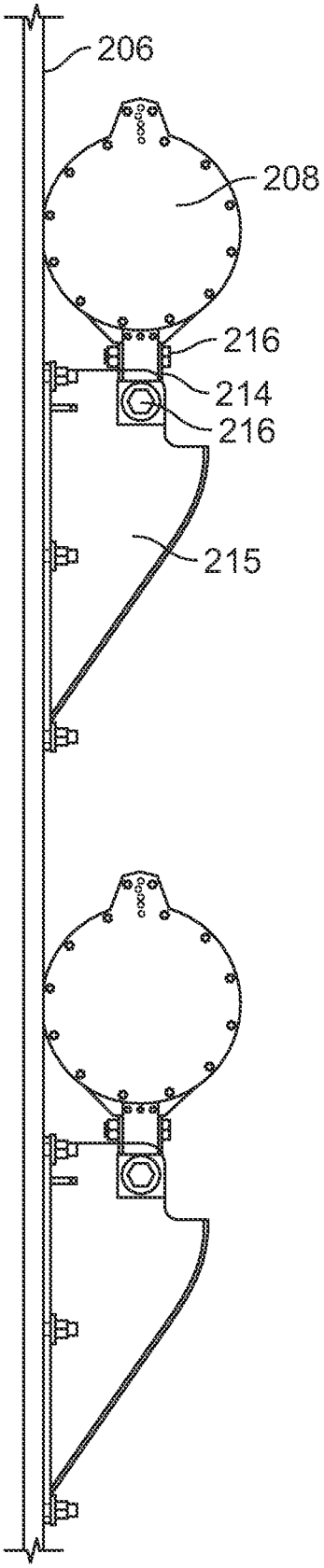
FIG. 9 is a top view of a housing assembly fixed to a sidewall of the ramp according to an embodiment of the present invention.

FIGS. 8 and 9 illustrate one of the housings 208, an associated swivel bracket 214 that is connected to the housing 208 and a bracket 215 to which the swivel bracket 214 is connected and that is fixed to a sidewall 206 of the safety system 200 with the housing 208 shown in different orientations in FIGS. 8 and 9.

Figure 10:
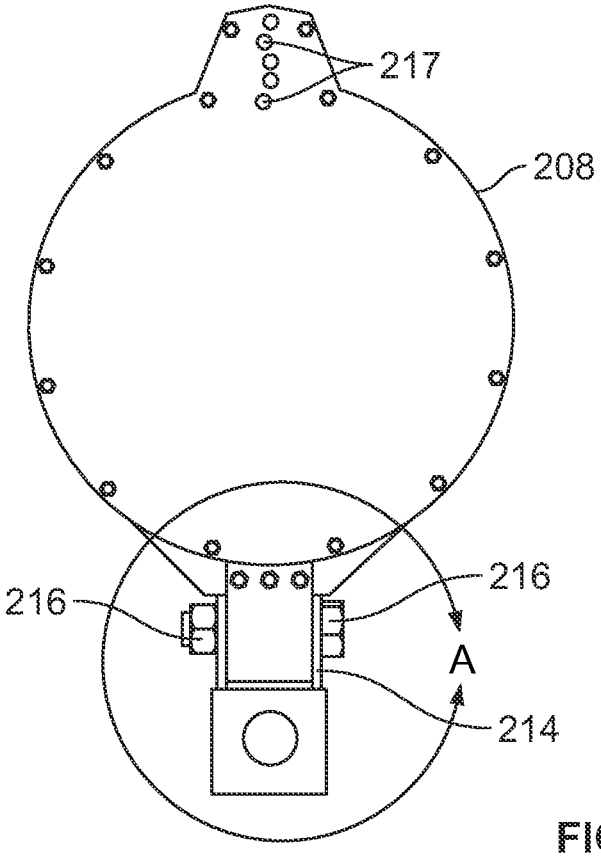
FIGS. 10 and 11 are views of the housing according to an embodiment of the present invention.
Figure 11:
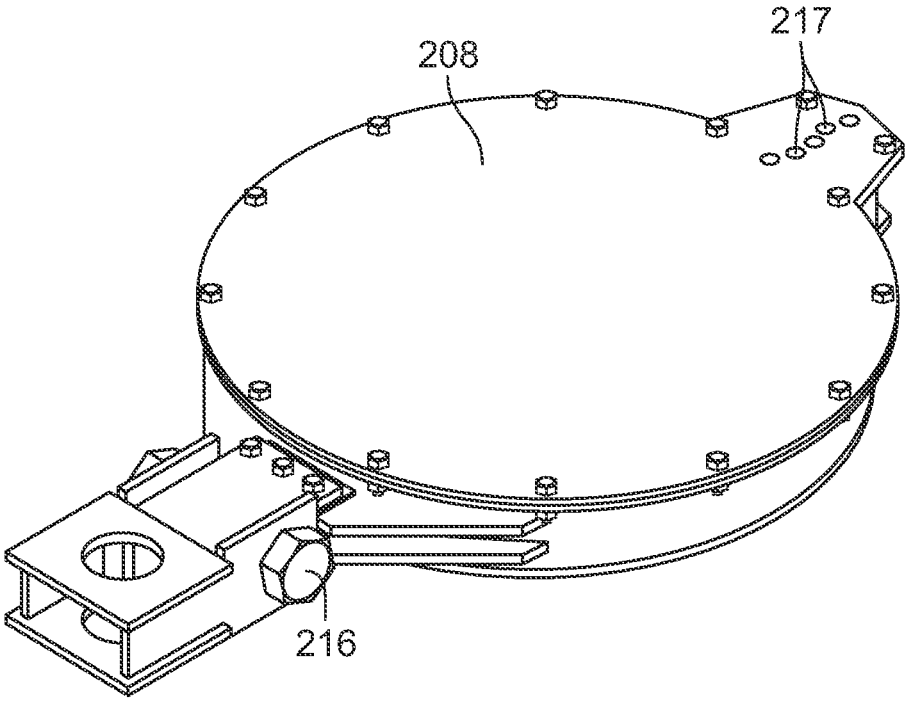
Figure 12:
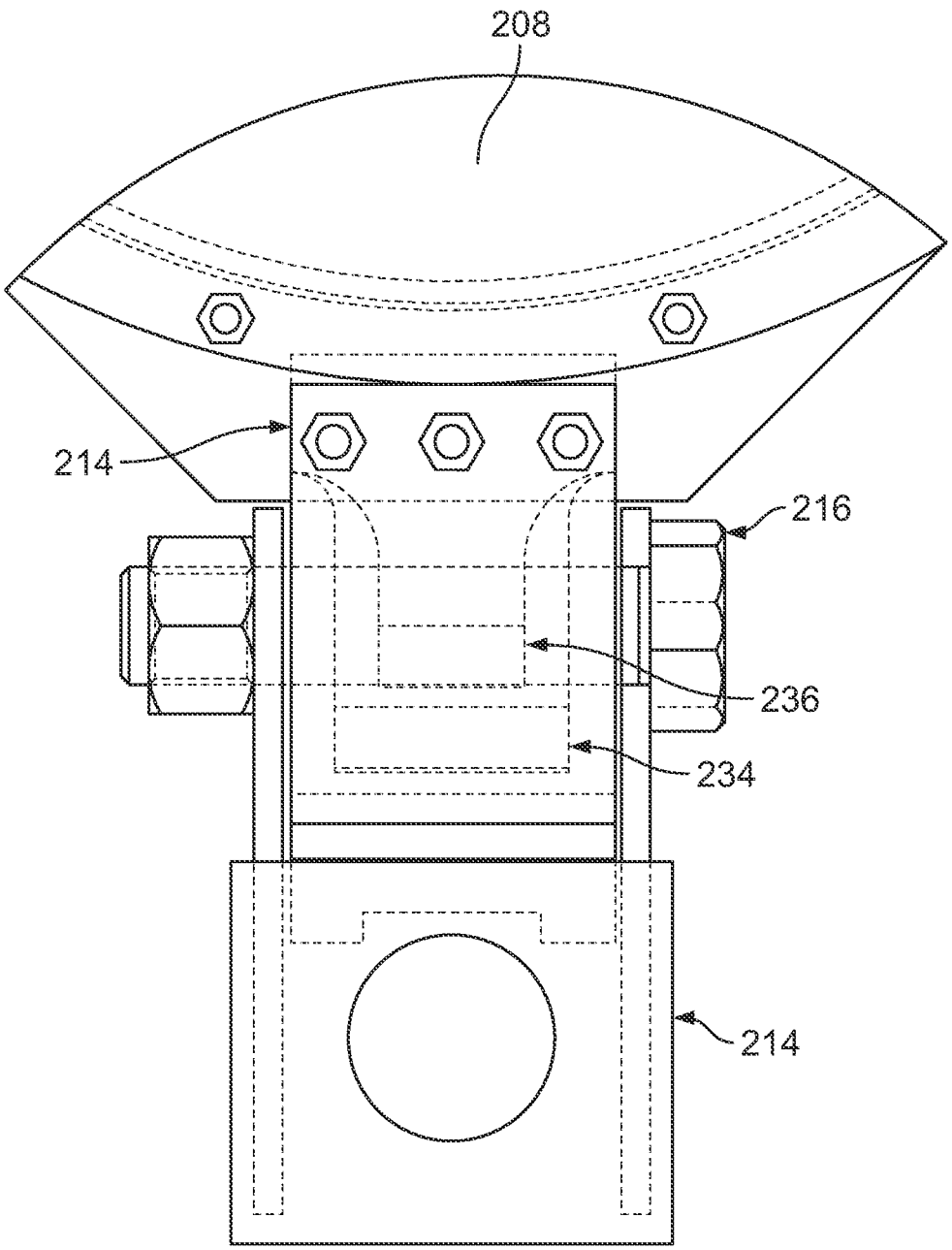
FIG. 12 is a detail view of FIG. 10 according to an embodiment of the present invention.
Figure 13:
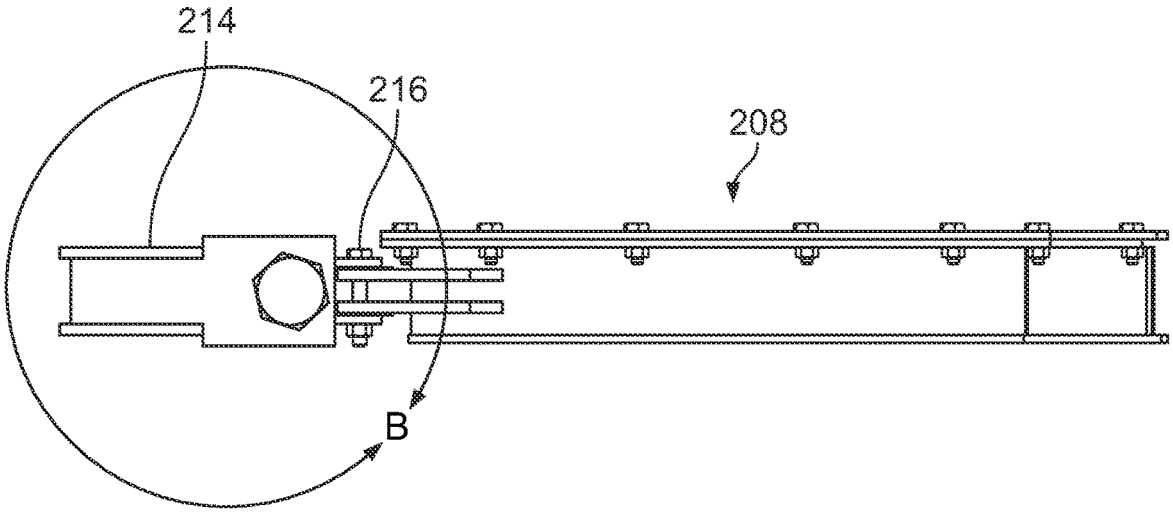
FIG. 13 is a side view of the housing assembly according to an embodiment of the present invention.
Figure 14:
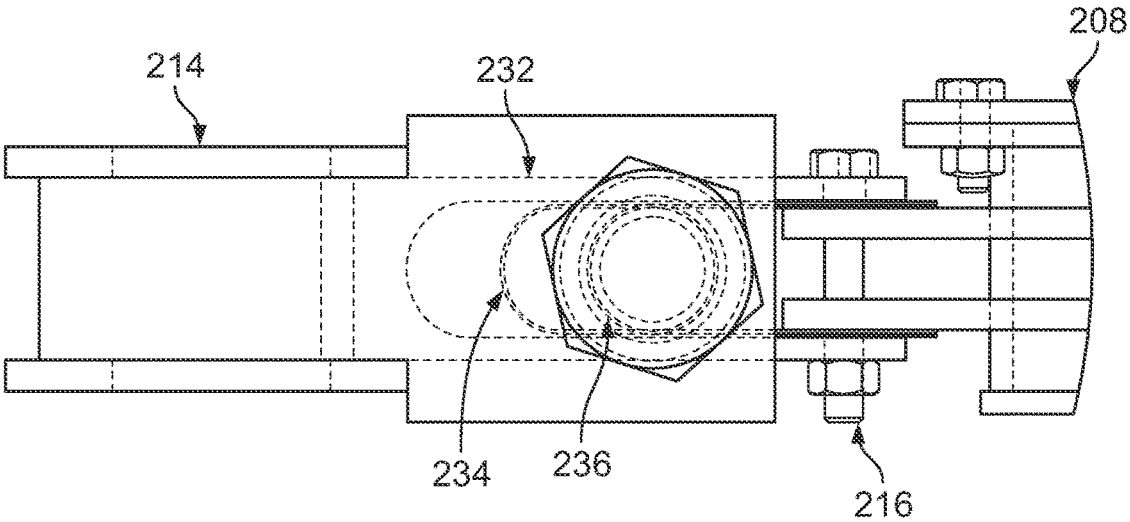
FIG. 14 is a detail view of FIG. 13 according to an embodiment of the present invention.

FIGS. 10-12 are various views of the housing 208 and the associated swivel bracket 214. As shown in FIGS. 13 and 14, the housing 208 is pivotable with respect to the bracket 214 about a bolt or pin 216.

Figure 15:
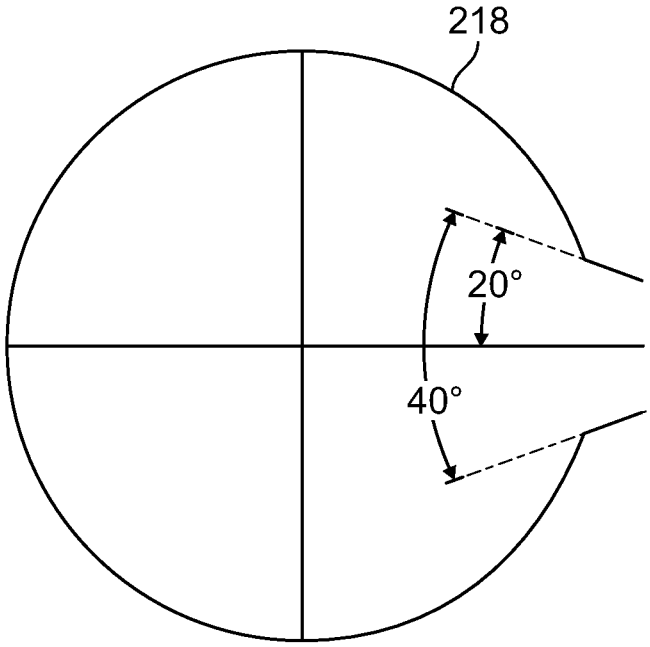
FIGS. 15 and 16 are views of a cover of the housing assembly according to an embodiment of the present invention.
Figure 16:
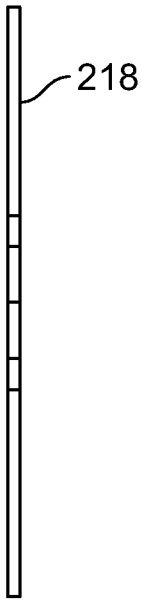
Figure 17:
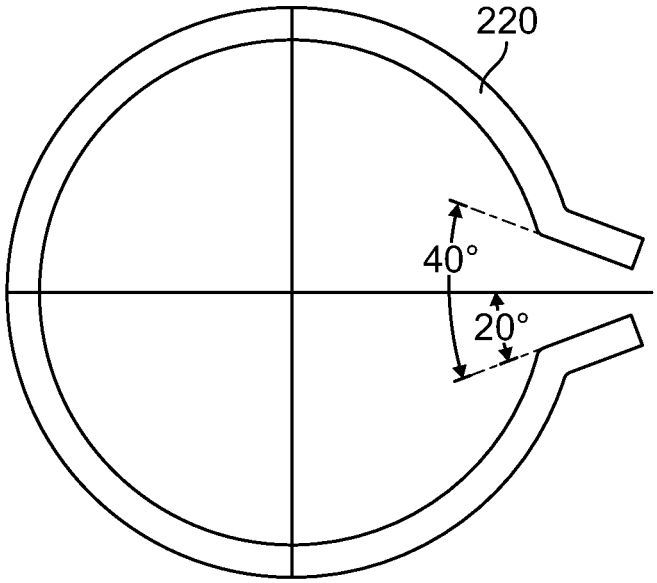
FIGS. 17 and 18 are views of a flange of the housing assembly according to an embodiment of the present invention.
Figure 18:
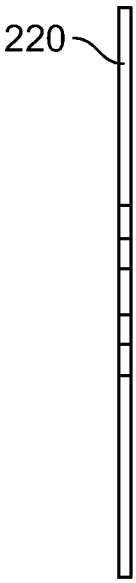
Figure 19:
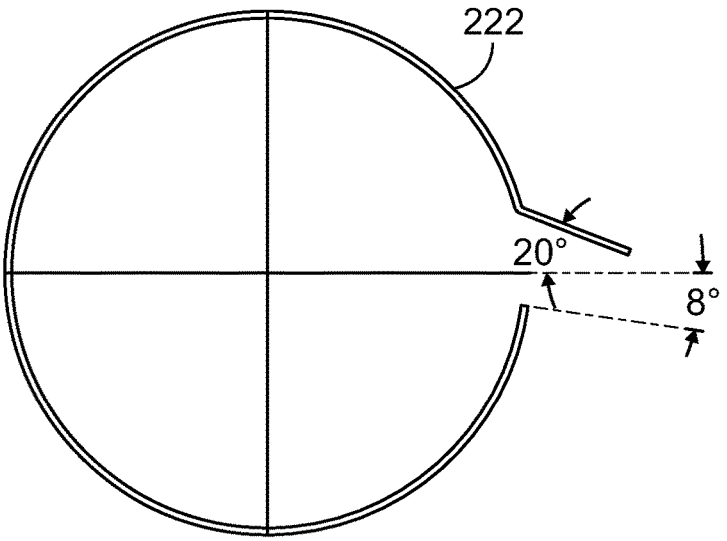
FIGS. 19 and 20 are views of the ring of the housing assembly according to an embodiment of the present invention.
Figure 20:
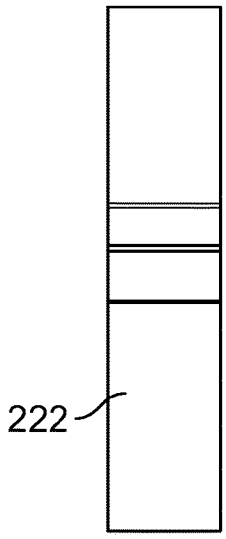
Figure 21:
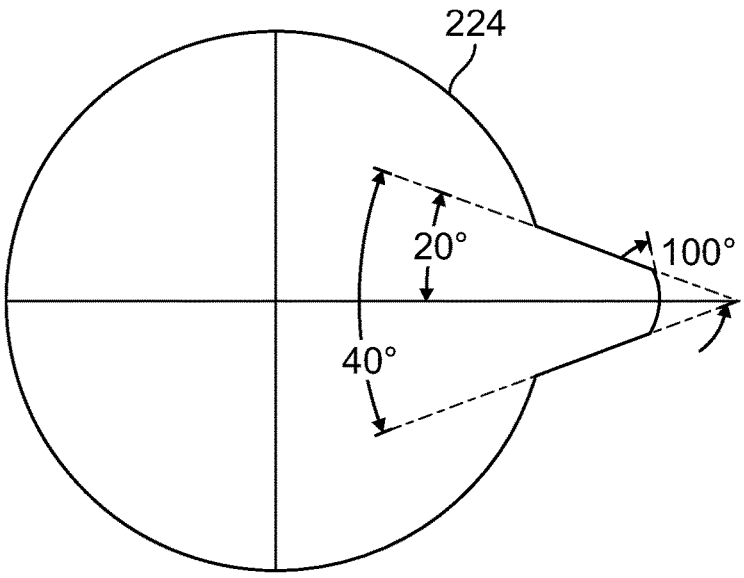
FIGS. 21 and 22 are views of a pan of the housing assembly according to an embodiment of the present invention.
Figure 22:
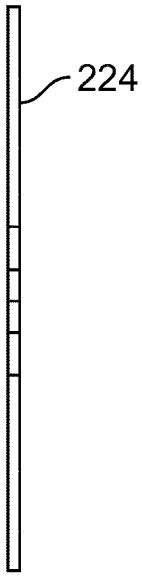
Figure 23:
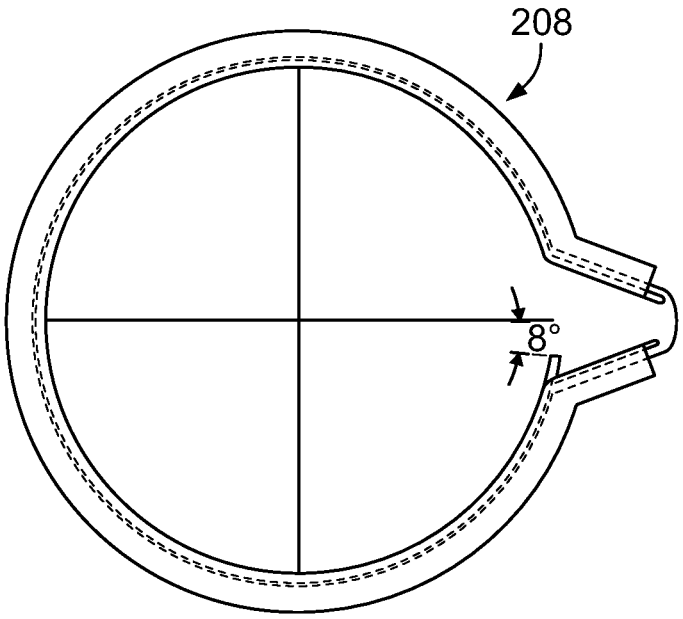
FIGS. 23-25 are views of a pan weldment of the housing assembly according to an embodiment of the present invention.
Figure 24:
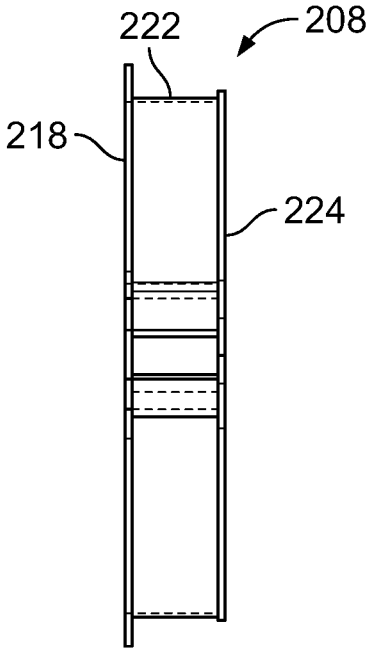
Figure 25:
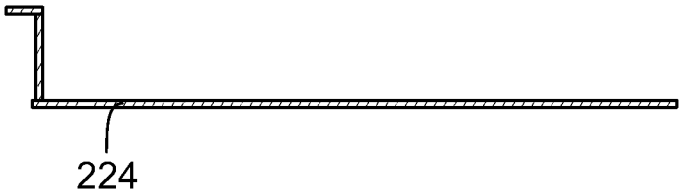
Figure 26:
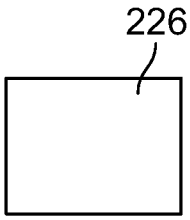
FIGS. 26 and 27 are detail views of FIG. 23 according to an embodiment of the present invention.
Figure 27:
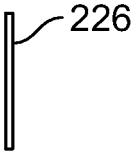
Figure 29:
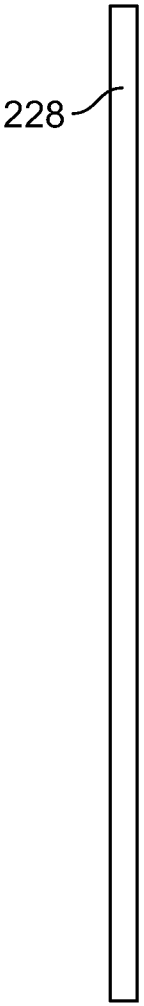
FIGS. 28 and 29 are views of a pan attachment of the housing assembly according to an embodiment of the present invention.
Figure 28:
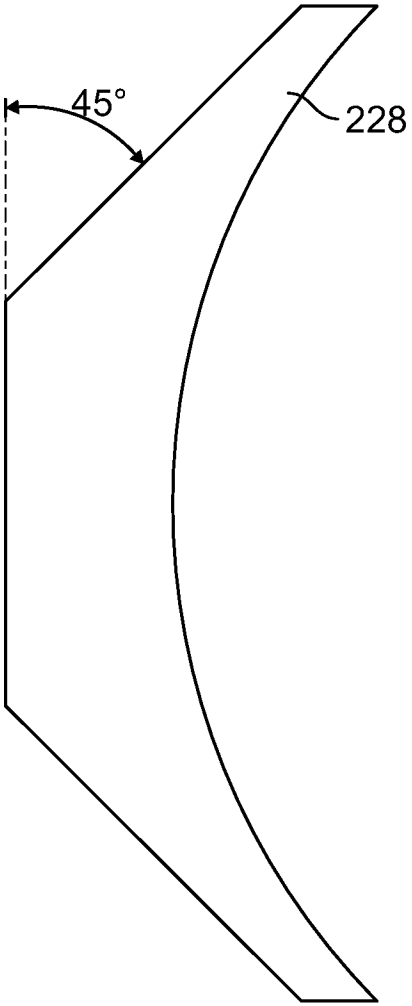
Figure 30:
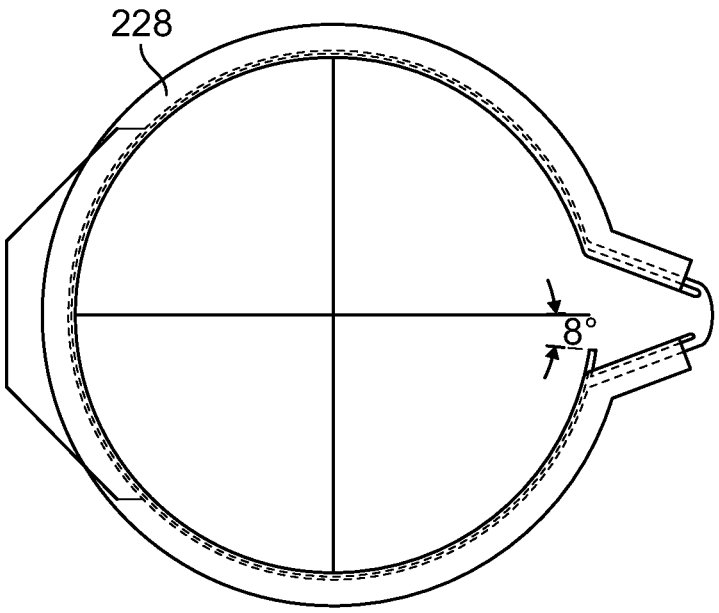
FIGS. 30 and 31 are views of a pan attachment weldment of the housing assembly according to an embodiment of the present invention.
Figure 31:
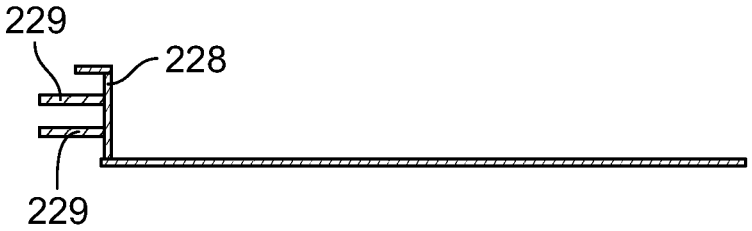

FIGS. 15 and 16 are views of the housing cover 218 plate. FIGS. 17 and 18 are views of the sidewall, or flange, 220 of the housing 208. FIGS. 19 and 20 are views of a ring 222 that forms the sidewall 220 of the housing 208. The ring 222 is positioned between the top of the flange 220 and a base pan 224 that is shown in FIGS. 23-27. FIGS. 21 and 22 are views of the base pan 224 of the housing 208. FIGS. 23-27 are views of the pan weldment 226 showing the sidewall 220 welded to the flange and base pan 224. FIGS. 28 and 29 are views of a flange 228 that is fixed via weld points (see FIGS. 30 and 31) to the sidewall 220 of the housing 208.

Figure 32:
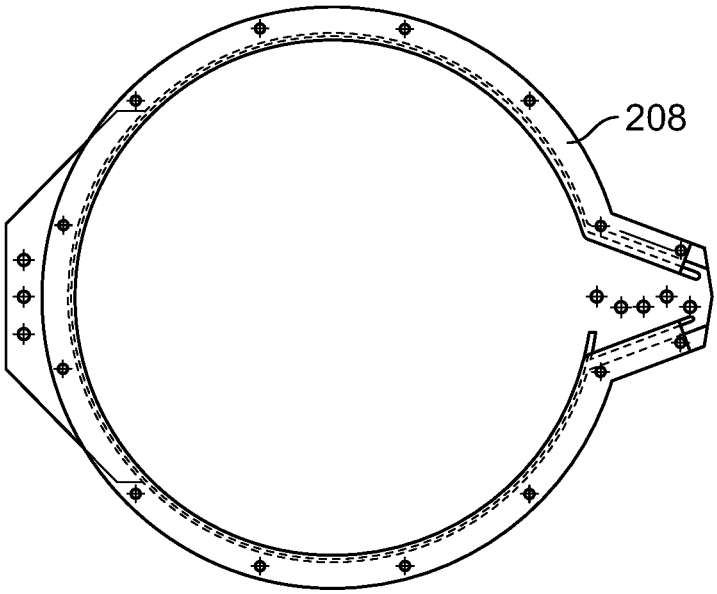
FIG. 32 is a view of the housing that is part of the housing assembly according to an embodiment of the present invention.

FIG. 32 is a top cross-sectional view of the housing assembly 208.

Figure 33:
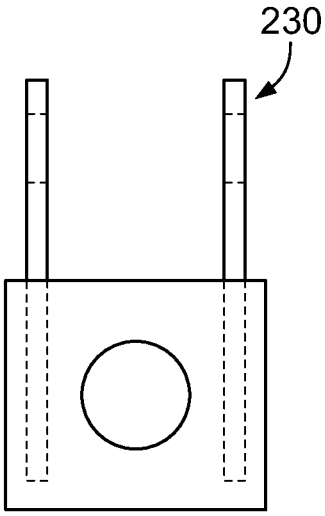
FIGS. 33 and 34 are views of a bracket assembly of the housing assembly according to an embodiment of the present invention.
Figure 34:
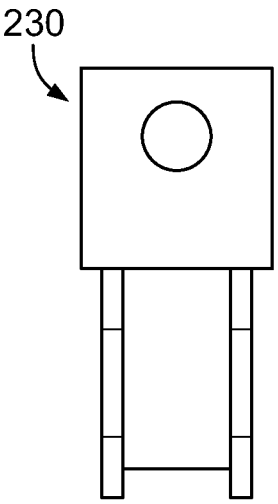
Figure 35:
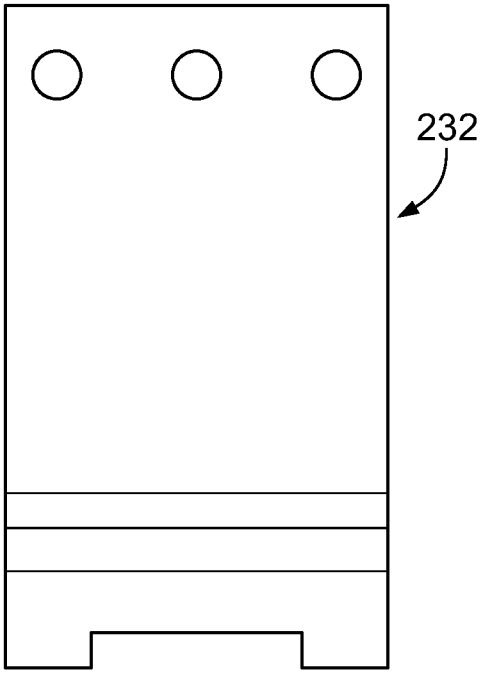
FIGS. 35 and 36 are views of a swivel bracket of the housing assembly according to an embodiment of the present invention.
Figure 36:
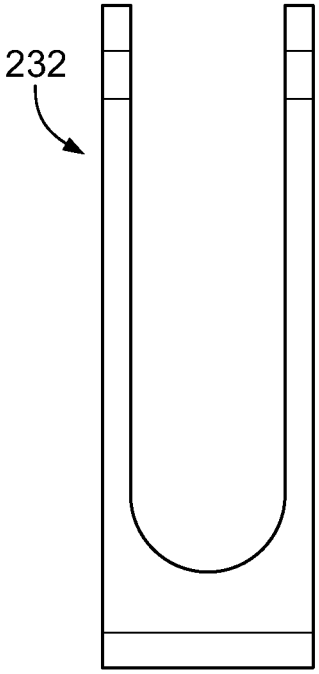

FIGS. 33 and 34 are views of a bracket assembly 230 that is fixable to the bracket 215 to support the housing 208 on the wall 206. FIGS. 35 and 36 are views of a swivable bracket 232 that interconnects the bracket assembly 230 to the housing 208.

Figure 37:
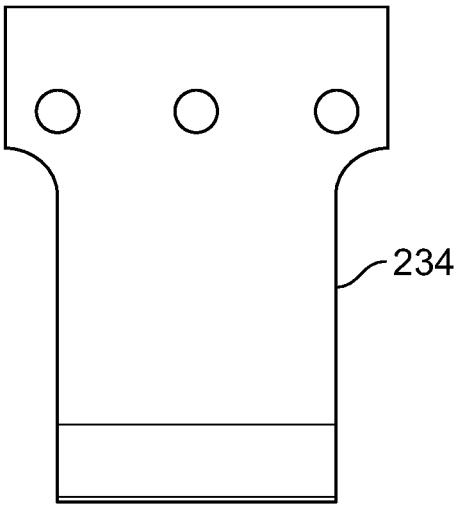
FIGS. 37 and 38 are views of a long absorber U-strap of the housing assembly according to an embodiment of the present invention.
Figure 38:
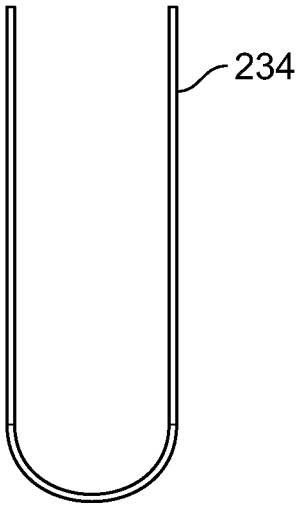

FIGS. 37 and 38 are views of a long absorber U-shaped strap 234.

Figure 39:
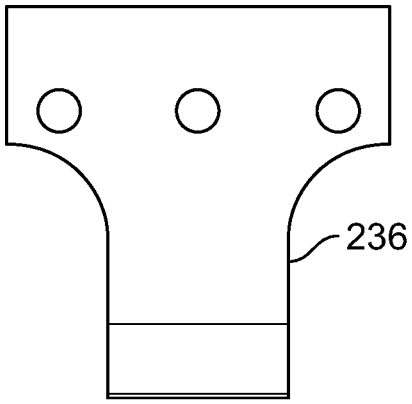
FIGS. 39 and 40 are views of a short absorber U-strap of the housing assembly according to an embodiment of the present invention.
Figure 40:
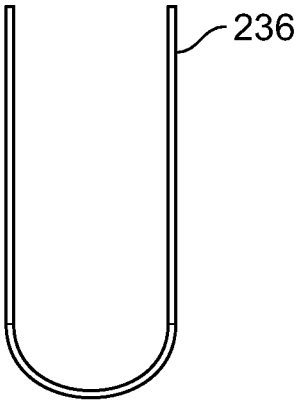

FIGS. 39 and 40 are views of a short absorber U-shaped strap 236.

The purpose of the long and short absorber 234, 236 is to cushion the initial impact load applied to the housing assembly or canister 208 by an impacting vehicle 201, the modified connection reduces the initial peak force by extending the time over which the steel strap is accelerated to the speed of the vehicle. This is accomplished using two steel straps that deform plastically at a load much lower than that required to pultrude the tape 212 through the offset pins 217. The first steel strap 236 begins to deform at approximately 25 percent of the pultrusion force of the tape 212. The second steel strap 234 begins to deform at approximately 50 percent of the pultrusion force of the tape 212. The first steel strap 236 is the short U-shaped strap 236 and the second steel strap 234 is the long U-shaped strap 234. This is best seen in FIGS. 12 and 14. When a load is applied, the short strap 234 stretches and breaks. Then, the long strap 234 starts to stretch and breaks. In addition, the first strap 236 makes sure that the canister housing 208 does not pull away from the mounting bracket until a load is applied and the strap breaks. The canister housing 208 cannot rotate vertically until the strap breaks so it stays horizontal with grade until an impact occurs.

In an embodiment, heating elements can be incorporated into the pavement of the ramp 202 to melt snow and ice.

Also, in an embodiment, the vehicle escape ramp 200 can be configured to bring an errant vehicle (e.g., pick-up truck) weighing about up to 4,400 pounds to a controlled, safe stop.

Although this invention has been disclosed in the context of certain embodiments and examples, it will be understood by those skilled in the art that the invention extends beyond the specifically disclosed embodiments to other alternative embodiments and/or uses of the invention and obvious modifications and equivalents thereof. It is to be understood that the phraseology or terminology employed herein is for the purpose of description and not of limitation. In addition, while several variations of the embodiments of the invention have been shown and described in detail, other modifications, which are within the scope of this invention, including, but not limited to, the substitutions of equivalent features, materials, or parts, will be readily apparent to those of skill in the art based upon this disclosure without departing from the spirit and scope of the invention.

What is claimed is:

1. A vehicle arresting system, comprising:

a ramp that includes a first sidewall and a second sidewall to delimit a first side and a second side, respectively, of the ramp;

at least one angled wall that extends from at least one of the first sidewall and the second sidewall; and at least one energy absorbing system fixed to and extending from at least one of the first sidewall and the second sidewall downstream of the at least one angled wall such that the at least one angled wall both directs an errant vehicle about the ramp and protects the at least one energy absorbing system from impact by the errant vehicle, the at least one energy absorbing system including at least one of an extendable one of a tape or cord.

2. The vehicle arresting system of claim 1, wherein the at least one angled wall includes at least one pair of angled walls that are arranged mirror opposite each other to direct an errant vehicle.

3. The vehicle arresting system of claim 1, wherein the at least one energy absorbing system includes a plurality of energy absorbing systems.

4. The vehicle arresting system of claim 1, wherein the at least one energy absorbing system includes a housing in which the at least one of the extendable one of a tape or cord is arranged and a bracket that is configured to allow the housing to rotate.

5. The vehicle arresting system of claim 1, further comprising a net that incorporates the at least one of the extendable one of a tape or cord that extends between the first sidewall and the second sidewall.

6. The vehicle arresting system of claim 4, wherein the bracket is fixed to a second bracket that is mounted to at least one of the first and the second sidewall by a fastener.

7. The vehicle arresting system of claim 1, wherein the at least one energy absorbing system includes a first absorber and a second absorber that are configured to cushion an initial impact load applied to the housing by an errant vehicle and extend the time the at least one of the extendable one of a tape or cord is accelerated to meet a speed of the errant vehicle.

8. The vehicle arresting system of claim 1, wherein the at least one of the extendable one of a tape or cord is comprised of steel.

9. The vehicle arresting system of claim 4, wherein the housing of the at least one energy absorbing system includes a first cover plate, a second cover plate and a sidewall with the first cover plate fixed to a first side of the sidewall and the second cover plate fixed to a second side of the sidewall.

10. The vehicle arresting system of claim 1, wherein the at least one energy absorbing system comprises a plurality of pins that are offset from each other with the at least one of the extendable one of a tape or cord arranged between the pins.

* * * * *